US007823576B2

(12) United States Patent
Timmons et al.

(10) Patent No.: US 7,823,576 B2
(45) Date of Patent: Nov. 2, 2010

(54) CONSUMABLE CHARCOAL STARTER

(76) Inventors: William Kernie Timmons, 5300 Foxfire Pl., Kingsport, TN (US) 37664; Connie Kay Timmons, 5300 Foxfire Pl., Kingsport, TN (US) 37664

( * ) Notice: Subject to any disclaimer, the term of this patent is extended or adjusted under 35 U.S.C. 154(b) by 217 days.

(21) Appl. No.: 12/032,799

(22) Filed: Feb. 18, 2008

(65) Prior Publication Data

US 2009/0205627 A1 Aug. 20, 2009

(51) Int. Cl.
*C10L 11/00* (2006.01)
*A47J 37/07* (2006.01)
*C10L 5/36* (2006.01)

(52) U.S. Cl. ..... 126/25 B; 126/9 A; 126/9 R; 126/25 R; 44/521; 44/533; 44/534

(58) Field of Classification Search ..... 126/9 A, 126/9 B, 9 R, 25 B, 25 R, 29, 59.5, 144, 168; 44/519, 520, 521, 530, 533, 534, 535, 540, 44/541; 206/735; *A01G 13/06; A47J 37/00, A47J 37/07; C10L 11/00, 11/04, 5/02, 5/36, C10L 5/40, 5/44; F24B 3/00*
See application file for complete search history.

(56) References Cited

U.S. PATENT DOCUMENTS

| | | | | |
|---|---|---|---|---|
| 73,922 | A | 1/1868 | Phulbrick | |
| 86,427 | A | 2/1869 | Loft | |
| 149,436 | A | 4/1874 | Brynon | |
| 181,033 | A | 8/1876 | Brown | |
| 236,889 | A | 1/1881 | Hammer et al. | |
| 242,741 | A | 6/1881 | Banks | |
| 308,140 | A | 11/1884 | Connelly | |
| 369,184 | A | 8/1887 | Johanson | |
| 748,312 | A | 12/1903 | Sackse | |
| 1,401,803 | A * | 12/1921 | Lynes | 44/519 |
| 1,866,931 | A | 7/1932 | Hefferman, Jr. et al. | |
| 1,919,407 | A | 7/1933 | Wood | |
| 1,959,472 | A | 5/1934 | Hefferman, Jr. et al. | |
| 1,959,473 | A * | 5/1934 | Heron | 44/519 |
| D094,923 | S | 3/1935 | Palmer | |
| 2,212,157 | A | 8/1940 | Fernholtz | |
| 2,738,260 | A * | 3/1956 | Wolfson et al. | 44/540 |
| 2,770,854 | A | 11/1956 | Miszeika | |
| 2,834,661 | A | 5/1958 | Chaplin | |
| 2,843,105 | A | 7/1958 | Badish | |
| D186,320 | S | 10/1959 | Mustin | |
| 2,920,614 | A * | 1/1960 | Phelps | 126/25 B |

(Continued)

FOREIGN PATENT DOCUMENTS

DE 3117349 A1 * 11/1982

(Continued)

*Primary Examiner*—Steven B McAllister
*Assistant Examiner*—Daniel E Namay
(74) *Attorney, Agent, or Firm*—Luedeka, Neely & Graham, P.C.

(57) ABSTRACT

The present disclosure relates to an apparatus for lighting charcoal, specifically a single-use, substantially consumable, chimney-style charcoal starter. The apparatus may include an open-ended, substantially tubular body, a charcoal support, and a fuel source. The apparatus may be charged with charcoal disposed upon the charcoal support. The apparatus may be fashioned such that as the fuel source burns, the charcoal may be ignited from the innermost coals to the outermost coals, at which point the apparatus may also be substantially consumed.

16 Claims, 5 Drawing Sheets

U.S. PATENT DOCUMENTS 2,933,378 A 4/1960 Mustin et al.
2,939,773 A 6/1960 Rymer
2,949,209 A 8/1960 Schott
2,955,029 A 10/1960 Foote
3,010,809 A * 11/1961 Peck ..... 44/520
3,028,228 A 4/1962 Chaplin
3,034,873 A * 5/1962 Weir ..... 44/534
3,060,868 A 10/1962 MacLachlan
3,073,263 A 1/1963 Wynkoop
3,112,716 A 12/1963 Knight
3,116,704 A 1/1964 Byars et al.
3,121,408 A 2/1964 Haning
3,122,109 A 2/1964 Waugh
3,167,040 A 1/1965 Byars et al.
3,168,062 A 2/1965 Arnold
3,177,826 A 4/1965 Cohen
3,191,556 A 6/1965 Hottenroth et al.
3,192,918 A 7/1965 Ridgway
3,209,712 A 10/1965 Arena
3,216,379 A 11/1965 Durfee
3,240,172 A 3/1966 Romberg et al.
3,269,807 A * 8/1966 Key, Jr. ..... 44/519
3,279,453 A 10/1966 Norehad et al.
3,296,984 A 1/1967 Durfee
3,307,506 A 3/1967 Rose
3,339,505 A 9/1967 Bean
3,370,582 A 2/1968 Rauh
3,374,071 A * 3/1968 Corriher, Jr. et al. ..... 44/521
3,377,147 A 4/1968 Romines
3,413,935 A 12/1968 Behms
3,453,975 A 7/1969 Gunter
3,494,349 A 2/1970 Allen
3,499,399 A * 3/1970 Kaufmann ..... 126/25 B
3,529,557 A 9/1970 Treanor
3,575,156 A 4/1971 Hosford
3,590,755 A 7/1971 Niemann
D223,722 S 5/1972 Stehouwer
3,682,154 A * 8/1972 Mollere ..... 126/9 A
3,684,087 A 8/1972 Anderson
3,734,034 A * 5/1973 Fowler ..... 126/25 B
3,739,732 A 6/1973 Graham
3,765,397 A 10/1973 Henderson
3,799,141 A 3/1974 Simmer
3,814,035 A 6/1974 Miller
3,865,052 A 2/1975 Streets et al.
3,883,317 A 5/1975 Neve
3,884,214 A 5/1975 Duncan
3,903,866 A 9/1975 Polinski
3,934,520 A * 1/1976 Brennan et al. ..... 126/25 B
3,957,455 A 5/1976 Clark
3,974,821 A 8/1976 Storandt
4,023,553 A 5/1977 London et al.
4,026,265 A 5/1977 Spadaro
D248,162 S 6/1978 Cavanaugh
4,094,649 A 6/1978 Osterried
4,095,957 A * 6/1978 Orsing ..... 44/540
4,099,916 A 7/1978 Gardner et al.
4,102,317 A 7/1978 Shonnard et al.
4,130,103 A 12/1978 Zimmerman
4,175,925 A 11/1979 Paek et al.
4,227,510 A 10/1980 Frazier et al.
4,240,363 A * 12/1980 Troy ..... 383/30
4,243,393 A 1/1981 Christian
4,282,854 A 8/1981 Byars
4,311,130 A 1/1982 Noose
4,321,907 A 3/1982 Sutter
4,331,125 A 5/1982 Storandt
4,417,565 A 11/1983 Karpinia
4,426,002 A 1/1984 Rez
4,460,377 A * 7/1984 Kalil ..... 44/520
4,461,270 A * 7/1984 Sutter ..... 126/25 B
4,478,601 A 10/1984 Stephens
4,503,835 A * 3/1985 Williams ..... 126/25 B
4,510,916 A 4/1985 Ogden
4,531,507 A * 7/1985 Gerson ..... 126/25 B
4,567,876 A * 2/1986 Ogden ..... 126/25 B
4,603,679 A 8/1986 Ogden
4,604,986 A 8/1986 Barnes
4,627,854 A * 12/1986 Pratt ..... 44/541
4,725,286 A 2/1988 Brane
4,762,525 A * 8/1988 Wood ..... 44/534
4,782,812 A 11/1988 Killerman
4,786,290 A * 11/1988 Wyer ..... 44/519
4,793,320 A 12/1988 Bakie
4,832,703 A 5/1989 Campana et al.
4,834,774 A 5/1989 Fay, III et al.
D304,574 S 11/1989 Fay, III
4,906,254 A * 3/1990 Antosko ..... 44/520
4,909,237 A 3/1990 Karpinia
4,953,533 A 9/1990 Witt
4,981,496 A 1/1991 Hausslein
5,143,045 A * 9/1992 Minnis ..... 126/25 B
D330,362 S 10/1992 Harris
5,197,455 A * 3/1993 Tessien ..... 126/25 B
5,230,325 A 7/1993 Williams
5,273,555 A 12/1993 DeCarlo
5,290,326 A * 3/1994 Campana ..... 44/519
5,293,859 A 3/1994 Lisher
5,374,289 A * 12/1994 Campana ..... 44/519
5,469,835 A 11/1995 Stephen et al.
5,626,636 A * 5/1997 Carter ..... 44/533
5,711,766 A 1/1998 Bein
5,743,248 A 4/1998 Jansen, Jr.
6,027,539 A 2/2000 Toy
6,328,028 B1 12/2001 Cape et al.
6,440,362 B1 8/2002 Bryant et al.
6,508,849 B1 * 1/2003 Comas ..... 44/543
6,631,711 B2 * 10/2003 Patience ..... 126/25 B
6,790,244 B2 9/2004 Sanders et al.
6,913,013 B1 * 7/2005 Mize ..... 126/25 B
7,172,637 B2 * 2/2007 Weissman et al. ..... 44/541
7,204,864 B2 4/2007 Stephens
2006/0255049 A1 * 11/2006 McCarthy et al. ..... 220/703
2007/0032608 A1 * 2/2007 McAlvin et al. ..... 525/445
2007/0298233 A1 * 12/2007 Dharmarajan et al. ..... 428/220
2008/0092437 A1 * 4/2008 Helms et al. ..... 44/520
2008/0159665 A1 * 7/2008 Callies ..... 383/105
2008/0276926 A1 * 11/2008 Chang ..... 126/25 R
2009/0095276 A1 * 4/2009 Kaye ..... 126/25 B

FOREIGN PATENT DOCUMENTS

EP 290414 A1 * 11/1988
FR 2706481 A1 * 12/1994
GB 223083 A * 1/1981
GB 2074309 A * 10/1981
GB 2091290 A * 7/1982
GB 2223569 A * 4/1990
GB 2247748 A * 3/1992
GB 2305599 A * 4/1997
GB 2389858 A * 12/2003
JP 62220592 A * 9/1987
JP 63075418 A * 4/1988
JP 08092580 A * 4/1996
WO WO 9527428 A1 * 10/1995
WO WO 2005073350 A1 * 8/2005

* cited by examiner

CONSUMABLE CHARCOAL STARTER

TECHNICAL FIELD

The present disclosure is related to the field of charcoal starters for igniting and preparing charcoal for use in cooking or grilling.

BACKGROUND

Charcoal is commonly used as a heat source for cooking or grilling foods. Typically, the charcoal must be prepared prior to cooking by igniting and burning a pile of the charcoal, often accompanied by or impregnated with petroleum-based accelerants, until the charcoal is lit. To aid in this task, charcoal starting utensils have been developed. One example of a charcoal starter can be found in U.S. Pat. No. 5,469,835 to Stephen et al. This is commonly known as a "chimney" style charcoal starter, since it permits airflow to be channeled upward through the burning coals, as in a chimney. However, the bulky metal construction and high heat retention of such starters can make them inconvenient to use. Also, the use of petroleum-based accelerants when lighting charcoal may be undesirable to many people.

It is therefore an object of the present disclosure to provide an easy to use, inexpensive, lightweight, chimney style charcoal starter that may be substantially consumed during the lighting of the charcoal, and that may only be substantially consumed at such time after the charcoal is lit and ready to use for cooking, and that may only use a minimal amount of petroleum-based accelerant to light the charcoal.

SUMMARY

In one embodiment, the present disclosure relates to an apparatus for lighting charcoal. The apparatus may include a substantially combustible tubular body having a base end and a second end distal from the base end. The body may include one or more ventilation apertures disposed proximal to the base end and a support for supporting a desired amount of charcoal within the tubular body in a position spaced apart from the base end such that a volume of air may be defined between the support and the base end. The apparatus may further include an easily combustible fuel source substantially centrally positioned beneath the support in the volume of air for lighting the charcoal disposed above the support.

The apparatus may be charged with charcoal, which may be disposed within the tubular body upon the support, and maintained in position by the support.

The tubular body may be spaced apart from the fuel source such that the ignition of the fuel source alone will not ignite the tubular body. The body may further be constructed of a sufficiently fire resistant combustible material to maintain structural integrity while the charcoal disposed upon the support is being lit and until the charcoal in the tubular body is substantially lit. Additionally, the tubular body may be sufficiently combustible to collapse and be substantially consumed after the charcoal is lit.

In some embodiments the tubular body may be a cardboard or paperboard tube having a substantially round cross-section. In other embodiments, the tubular body may be a cardboard or paperboard tube having a substantially rectangular cross-section. The tubular body may be made from paperboard or cardboard having a fire-resistant clay coating, or the body may be made from a sufficiently thick uncoated material so as to be fire-resistant.

The support may be made from a wire mesh, which may be formed into an arched shape. The fuel source may be attached to the top of the arch, whereby the charcoal in the tubular body at least partially shields the tubular body from the heat of the firestarter.

The tubular body may further include one or more secondary apertures, and the support may further include one or more stabilization hooks configured for engagement with the tubular body through the secondary apertures.

In some embodiments, the apparatus may be substantially collapsible or foldable when devoid of charcoal. In such embodiments, the apparatus may further comprise two opposed fold lines on the tubular body, and the support may be configured and positioned for folding within the tubular body and allowing the tubular body to fold along the fold lines, whereby the tubular body and the support may be folded into a flattened configuration, and unfolded into an expanded configuration for supporting and lighting charcoal. The tubular body may further include one or more secondary apertures, and the support may further include one or more stabilization hooks configured for engagement with the tubular body through the secondary apertures, and the hooks may engage and disengage the secondary apertures as the apparatus is expanded and flattened.

Some advantages of the apparatus of the present disclosure are that it is easy to use, lightweight, inexpensive, and substantially consumable in a single use. A further advantage is that the apparatus may be used to ignite charcoal without requiring any additional petroleum-based accelerant other than the initial fuel source provided.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, or the claims.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DESCRIPTION OF THE EXEMPLARY EMBODIMENTS

The present disclosure will now be described in the more limited aspects of preferred embodiments thereof, including various examples and illustrations of the structure and use of the present disclosure. It will be understood that these embodiments are presented solely for the purpose of illustrating the invention and shall not be considered as a limitation upon the scope thereof.

Unless otherwise stated, as used herein, the terms "combust", "burn", "ignite", "light", and "start" all refer to the act of causing a material to burn, and may be used in any of their forms interchangeably herein. Likewise, the terms "igniter", "lighter", and "starter" may be used interchangeably in reference to various embodiments of the present disclosure. In addition, the words "fire" and "flame" may be used interchangeably herein.

As used herein, the term "easily combustible" is used to describe a material that begins to burn upon contact with a small flame (e.g., a match flame). For example, a petroleum-based accelerant impregnated block of compressed wood chips is easily combustible.

As used herein, the terms "substantially combustible" and "substantially consumable" are used to describe a material or materials that may be burned in a charcoal fire, a major portion of which may be burned and a minor portion of which may be left unburned.

The term "sufficiently fire resistant combustible material" means a material having properties that may enable the material to resist combustion upon continued exposure to heat and/or flame from a charcoal fire for a determinate period of time sufficient to light the charcoal, yet after the determinate period of time of continued exposure to heat and/or flame, may burn.

In one embodiment, the present disclosure may provide an apparatus for lighting charcoal, which may be a substantially combustible, single-use, chimney style charcoal starter. The apparatus may include an open-ended, substantially tubular, sufficiently fire resistant combustible body, a charcoal support, and a fuel source. The apparatus may be charged with charcoal disposed upon the support member within the tubular body.

The apparatus may be fashioned such that as the fuel source burns, the charcoal in the tubular body may at least partially shield the tubular body from the heat of the burning fuel source, and the charcoal may be ignited from the innermost coals to the outermost coals, at which point the apparatus itself may also be substantially consumed.

Figure 1:
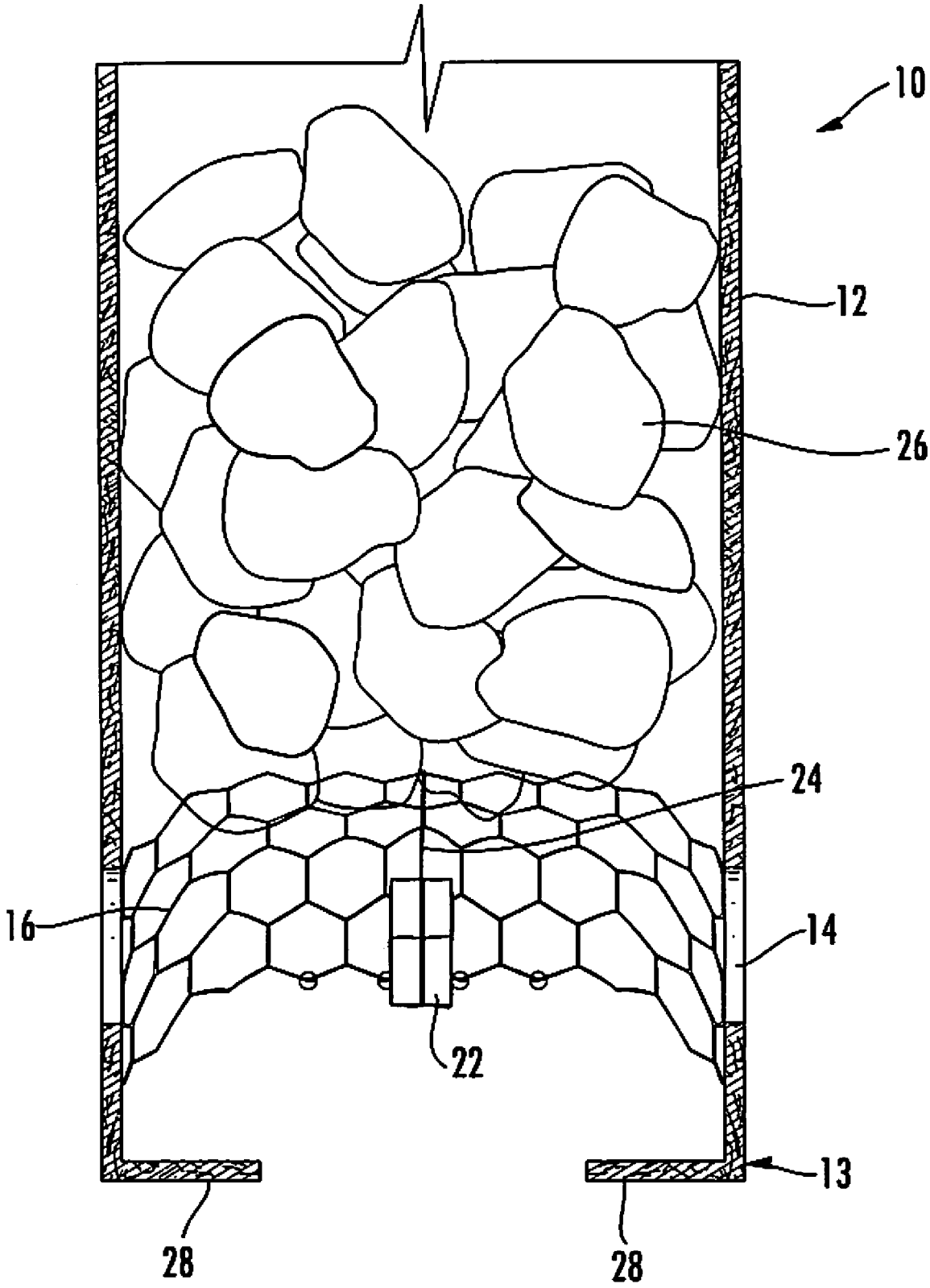
FIG. 1 is a cross-sectional diagram of one embodiment of a charcoal starter in accordance with the present disclosure.

With reference to FIG. 1, an exemplary embodiment of an apparatus in accordance with the present disclosure may be a chimney style charcoal starter 10 that may include a substantially tubular body 12 made from a pre-cut section of paperboard or cardboard, or other suitable sufficiently fire resistant combustible body material, such as a polymeric material, or a material having a fire-resistant coating.

In some embodiments, the paperboard may be provided with a clay or other flame-retardant coating to slow down burning of the body 12. The paperboard may be coated on one or both sides, or not at all. A desirable paperboard may range from about 0.010 inches to about 0.050 inches in thickness, with a paperboard ranging from about 0.015 inches to about 0.025 inches being particularly suitable. In one embodiment, the paperboard may be about 0.020 inches in thickness.

Desirably, the tubular body 12 may be constructed of a sufficiently fire-resistant combustible material to maintain structural integrity during the lighting of the charcoal, wherein the body 12 may be sufficiently combustible to collapse and be substantially consumed after such time when the charcoal is lit. Sufficient fire resistance may be achieved through fire resistant coatings, such as clay, increasing the thickness of the material, and combinations thereof.

The body 12 may have one or more ventilation apertures 14 formed proximal to a base end 13 thereof. The ventilation apertures 14 may range in size from about 1 cm across to about 5 cm across, and from about 1 cm in height to about 5 cm in height. It may be desirable that all apertures be formed in the pre-cut section of body material prior to the assembly of the starter.

The pre-cut material of the body 12 may then be formed or folded into the desired shape and opposing edges of the material may be glued, stapled, or otherwise affixed together to provide a substantially tubular body 12 suitable for containing a desired amount of charcoal to light. The height of the body 12 may range from about 6 inches to about 24 inches tall. In some embodiments, the tubular body 12 may range from about 4 to about 12 inches in diameter, and as a further example from about 4 to about 9 inches in diameter, although other diameters and heights outside the ranges listed herein may also be suitable, and are intended to fall within the scope and spirit of the present specification.

A charcoal support 16 may be fixedly attached within the body 12, so that a desired amount of charcoal may be supported, which in some embodiments may be disposed at least partially above the ventilation apertures 14. The support 16 may be made from a pre-cut piece of wire mesh or screen, or other suitably firm yet pliable, substantially heat resistant material, for example a heat-resistant polymeric material, that may be formed into a suitably supportive shape, such as an arched or curved shape. The support 16 may be disposed within the tubular body 12 in a position spaced apart from the base end 13 of the body 12 such that a volume of air is defined between the support 16 and the base end 13.

An easily combustible fuel source 22 may be positioned beneath the support 16. The fuel source 22 may include a pre-formed firestarter block, for example a pre-cut block of petroleum accelerant impregnated compressed wood chips, or other suitable fuel source. The fuel source 22 will begin to burn upon contact with a flame. It is desirable that the fuel source 22 be positioned substantially centrally beneath the support 16, so as not to prematurely ignite the body 12. The fuel source 22 may be affixed to the support with a small piece of wire 24, or by stapling, or other heat-resistant attachment means.

The tubular body 12 may be spaced apart from the fuel source 22, such that an initial ignition of the fuel source will not immediately ignite the tubular body. For example, the fuel source 22 may be substantially centrally disposed beneath the support 16, at a top of an arch thereof. A further advantage of having an arch-shaped support 16 and a fuel source 22 spaced apart from the tubular body 12 may be that such a configuration allows charcoal to be disposed around the outer edge of the tubular body 12 below the level of the fuel source 22, so that the charcoal may at least partially shield the tubular body 12 from premature ignition by the burning fuel source 22.

The starter 10 may be charged with a desired amount of charcoal 26. The desired amount of charcoal 26 may be disposed within the body 12 and upon the charcoal support 16. In one embodiment a suitable amount of charcoal 26 may range from about 30-50 charcoal briquettes, for example about 40 charcoal briquettes. In other embodiments, more or less charcoal 26 may be desired, depending on the dimensions of the starter 10.

In some embodiments, the starter 10 may be charged with charcoal 26 by the user, while in other embodiments, the starter 10 may be pre-charged with charcoal 26 prior to packaging for sale.

Figure 2A:
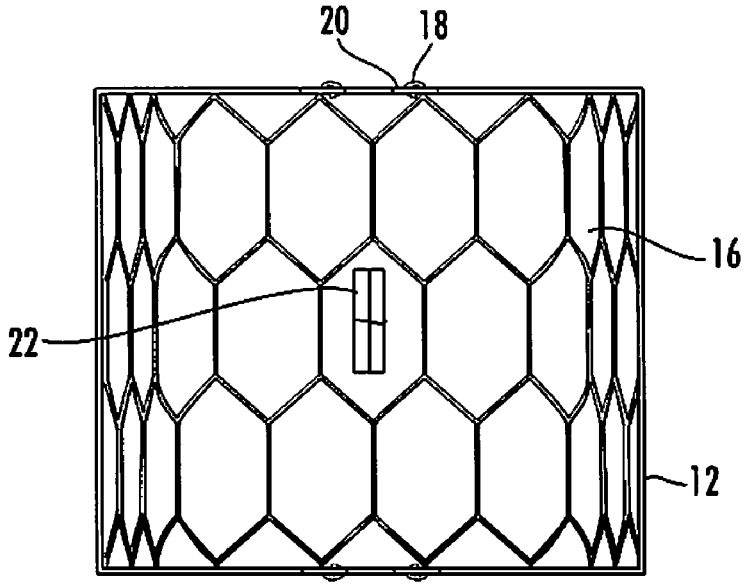
FIGS. 2*a* and 2*b* are top-down views looking into embodiments of charcoal starters prior to the starters being charged with charcoal.
Figure 2B:
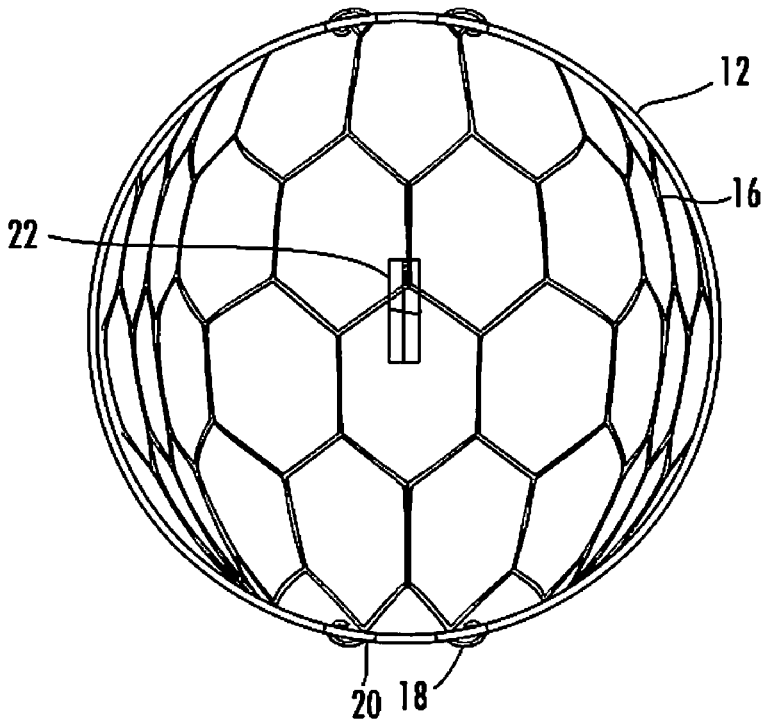

With reference now to FIGS. 2*a* and 2*b*, top-down views looking into a starter 10 according to the present disclosure are illustrated. In some embodiments, the body 12 may be substantially rectangular in cross section, as shown in FIG. 2*a*. Alternatively, the body 12 may be substantially circular in cross-section, as shown in FIG. 2*b*.

The charcoal support 16 may further include one or more wire hooks 18 disposed thereupon for attachment through one or more small hook, or secondary, apertures 20 that may be present in the body 12. The one or more hooks 18 may be formed on, or as part of, the support 16. The hooks 18 may be engaged through suitably positioned hook apertures 20 in the body 12, whereby the hooks 18 in the support 16 having been engaged through the secondary apertures 20 may provide additional stability to the body 12 and the support 16. It is particularly desirable that the secondary apertures 20 be disposed more distal from the base 13 of the starter 10 than the ventilation apertures 14 (i.e., the secondary apertures 20 may be found over or above the location of the ventilation apertures 14).

Although the embodiments described herein illustrate the use of hooks 18 to provide additional stability to the body 12 and the support 16, the present disclosure is not intended to be limited to such hooks 18. It is therefore contemplated that in alternative embodiments, increased stabilization of the body 12 and the support 16 may be achieved through the replacement of the hooks 18 with rivets, staples, or other fastening means commonly known in the art. As a further alternative, the support 16 may be formed from a material rigid enough to maintain a desired shape without a need for any hooks 18.

In some embodiments, the support 16 may be formed from a pre-cut section of a light gauge wire mesh, such as chicken-wire. In these embodiments, the wire mesh may be cut in such a manner as to leave short stubs of the wire exposed. The hooks 18 may be formed from bending some of the stubs into a hooked shape, while any remaining stubs not used to form the hooks 18 may simply be bent inward, or downward, or be cut off, so as not to contact or engage the body 12.

Figure 3:
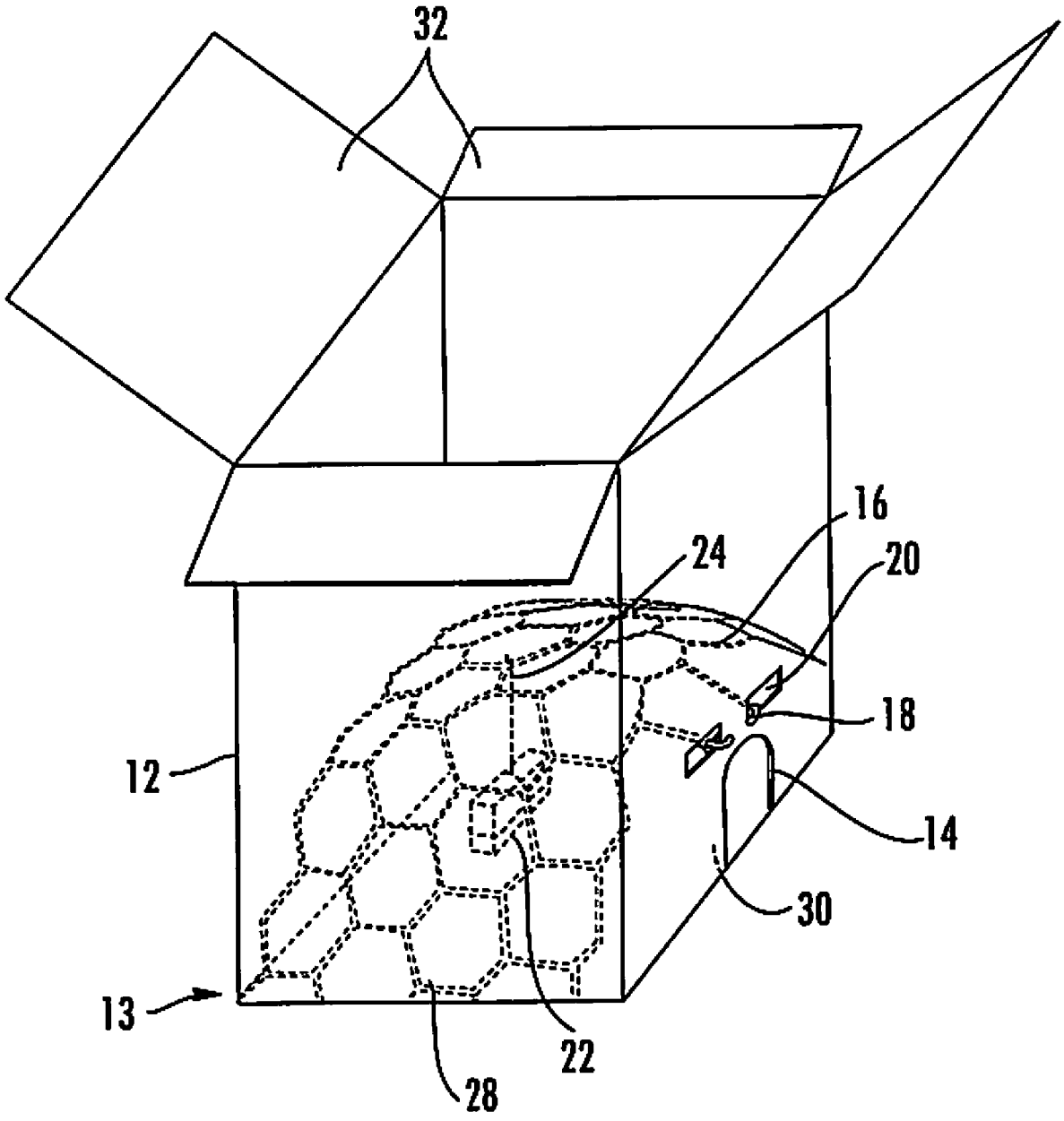
FIG. 3 is a diagrammatic illustration of another embodiment of a charcoal starter according to the present disclosure.

With reference now to FIG. 3, additional stability may be provided to the body 12 through the addition of internally extending base flaps 28. The base flaps may be formed from the same material as the body 12, and they may be folded inward and fixedly attached to one another by glue, staples, or other attachment means, in such a manner as to provide a fixed shelf-like portion ("shelf") 30 disposed along the inside of the base of the body 12. The internally extending base shelf 30 may help provide further stabilization to the body 12, without enclosing interior of the base end 13 of the body 12, so that even when having the base shelf 30, the body 12 may remain substantially tubular.

In a further embodiment, the starter 10 may also be provided with one or more top flaps 32, which may be made from the same material as the body 12. The top flaps 32 may be particularly desirable for starters 10 that may be pre-charged with charcoal 26 and stacked for sale, such as in a retail display. In such embodiments, the top flaps 32 may be opened by the user prior to use of the starter 10. The opening of the top flaps 32 prior to, or immediately following, the igniting of the fuel source 22 improves air and heat flow through the starter 10. The top flaps 32 may each be about the same size, or they may each be different sizes.

Figure 4:
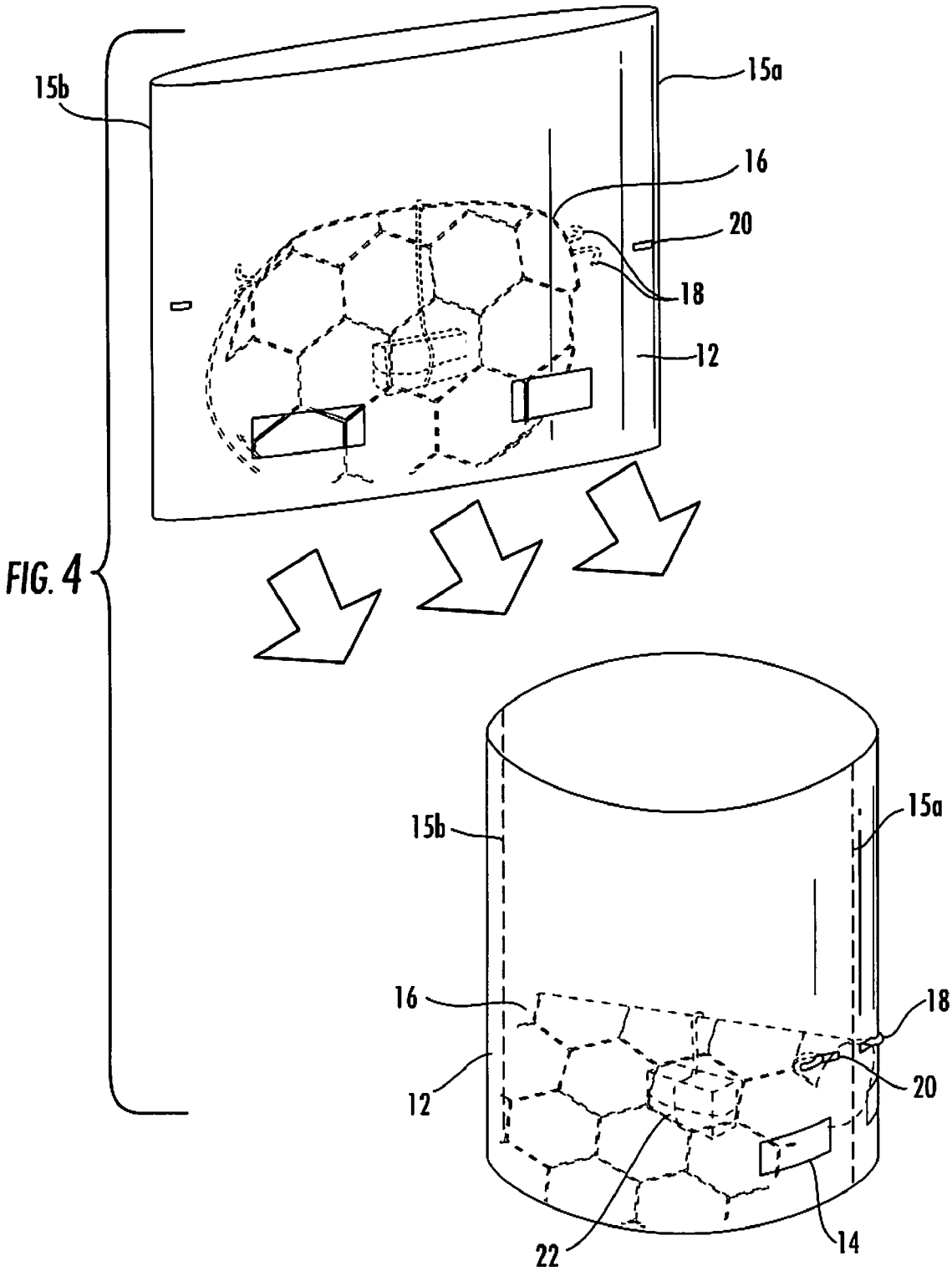
FIG. 4 is a diagrammatic illustration of a collapsible embodiment of a charcoal starter according to the present disclosure, illustrating both the collapsed and expanded states of the starter.

As shown in FIG. 4, in an alternative embodiment, the starter 10 is substantially collapsible prior to being charged with charcoal. In such an embodiment, the starter may have a substantially collapsible body 12 and a substantially collapsible charcoal support 16, permitting the starter 10 to be folded and stored prior to use.

Two opposed fold lines 15*a* and 15*b* may be included on the tubular body 12, and the support 16 may be configured and positioned for folding within the tubular body 12 as the tubular body 12 folds along the fold lines 15*a* and 15*b*. The body 12 and the support 16 may thus be folded into a flattened or collapsed configuration, and unfolded into an expanded configuration for supporting and lighting charcoal. The hooks 18 may engage the secondary apertures 20 as the starter 10 is expanded, and said hooks 18 may be disengaged from the secondary apertures 20 as the starter 10 is collapsed.

It is also acceptable for more than two fold lines to be present on the body.

At the time of use, the starter 10 may simply be unfolded or expanded from a collapsed state, the hooks 18 engaged through the secondary apertures 20, and the starter 10 charged with charcoal.

Figure 5:
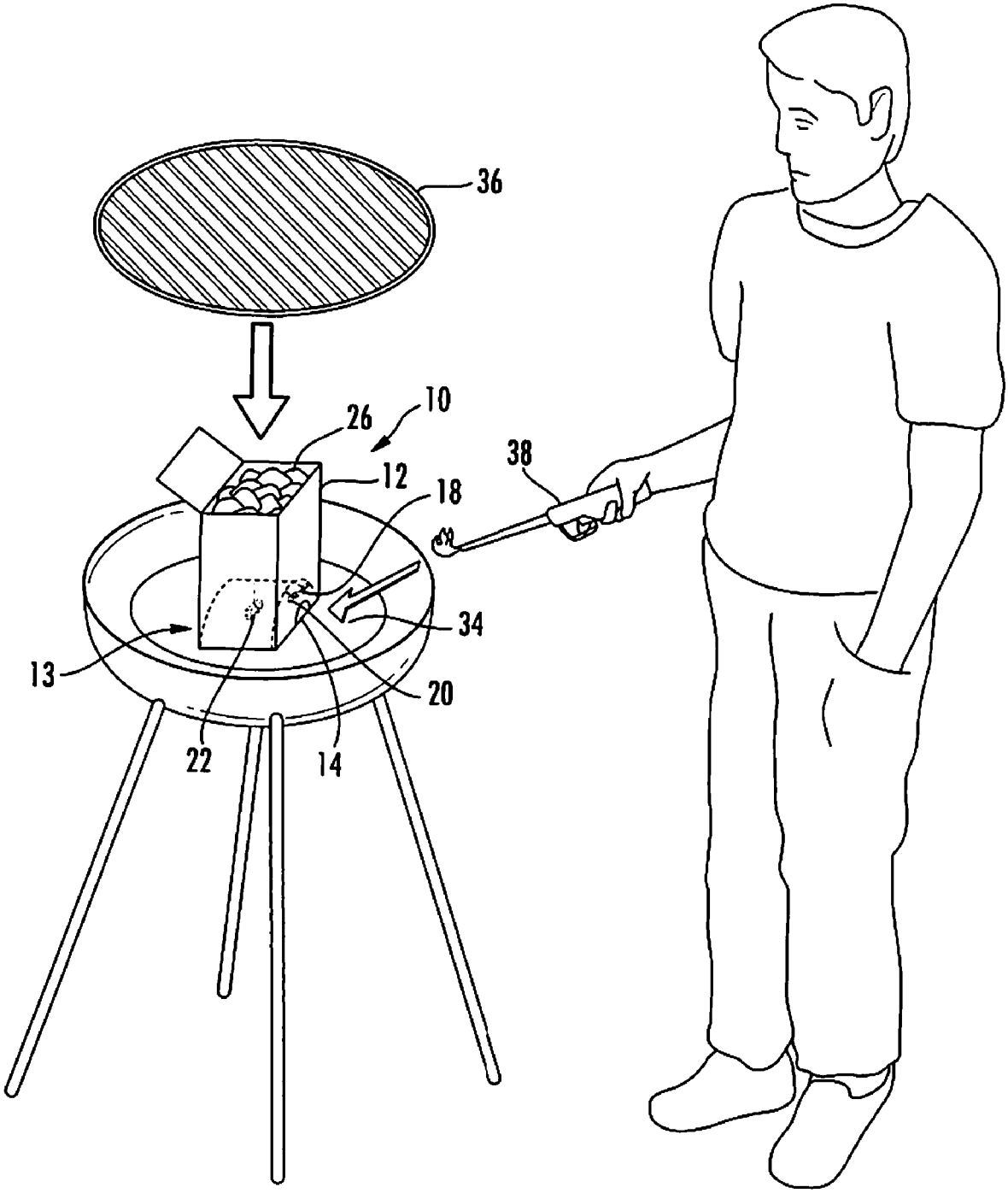
FIG. 5 is a diagrammatic illustration of a use of the charcoal starter of the present disclosure.

With reference now to FIG. 5, in order to use the charcoal starter described herein, one would simply place the starter upon a grilling surface 34, such as a charcoal grill or a fire-pit. The user may then charge the starter 10 by adding the desired amount of charcoal 26 to the starter 10 upon of the charcoal support 16. In an alternative embodiment, the starter 10 may be provided pre-charged with the desired amount of charcoal 26.

A source of fire 38, for example a match or a lighter, may then be extended through one of the ventilation apertures 14, or through the open base of the starter 10, and to contact the fuel source 22 thereby igniting said fuel source 22, and causing the charcoal 26 to be ignited. In this manner, the charcoal 26 will burn from the innermost portion toward the outermost portion, assisted by air flowing inward through the ventilation apertures 14, upward through the charcoal 26, and exiting at the top of the starter 10.

After a determinate period of time, the starter 10 may be consumed, and the charcoal 26 may be spread out on the grilling surface 34 and the cooking grill 36 may be placed over the lit charcoal 26 for cooking food on the cooking grill 36 surface. In some embodiments, the starter 10 may take from about 10 to about 30 minutes before the charcoal 26 may be substantially lit and the starter 10 itself may be substantially consumed. Accordingly, the starter 10 may be made from a sufficiently flame resistant combustible material to maintain structural integrity until the charcoal 26 is substantially lit, at which point the starter 10 and the charcoal 26 may collapse and be substantially consumed by burning.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as percent, ratio, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. An apparatus for lighting charcoal, comprising:

a substantially combustible tubular body having a base end and a second end distal from the base end, a support for supporting a desired amount of charcoal within the tubular body in a position spaced apart from the base end such that a volume of air is defined between the support and the base end, ventilation structure provided near the base end for providing an air supply to the charcoal, an easily combustible fuel source substantially centrally positioned beneath the support in the volume of air for lighting the charcoal disposed above the support, the easily combustible fuel source being spaced apart from the sides and base end of the tubular body such that a volume of air substantially surrounds the easily combustible fuel source;

the tubular body being spaced apart from the fuel source such that the ignition of the fuel source will not ignite the tubular body, and being constructed of a sufficiently fire resistant combustible material to maintain structural integrity while the charcoal on the support is being lit and until the charcoal in the tubular body is substantially lit, said tubular body being sufficiently combustible to collapse and be substantially combusted after the charcoal is lit.

2. The apparatus of claim 1 wherein the tubular body comprises a paperboard tube having a substantially circular cross-section.

3. The apparatus of claim 1, wherein the tubular body comprises paperboard tube having a substantially rectangular cross-section.

4. The apparatus of claim 1, wherein the support comprises wire mesh.

5. The apparatus of claim 1, wherein the fuel source comprises a pre-formed firestarter block.

6. The apparatus of claim 1, further comprising two opposed fold lines on the tubular body and wherein the support is configured and positioned for folding within the tubular body and allowing the tubular body to fold along the fold lines, whereby the tubular body and the support may be folded into a flattened configuration and unfolded into an expanded configuration for supporting and lighting charcoal.

7. The apparatus of claim 1, wherein the support comprises an arched support.

8. The apparatus of claim 1, wherein the support comprises an arched support, and wherein the easily combustible fuel source is disposed at a top of the arched support spaced above and apart from the base end of the tubular body, and wherein the charcoal disposed upon the support at least partially shields the tubular body from ignition by the easily combustible fuel source.

9. The apparatus of claim 1, wherein the tubular body further comprises one or more flaps disposed at the second end.

10. The apparatus of claim 1, wherein the apparatus is charged with charcoal disposed upon the support member within the tubular body.

11. The apparatus of claim 1, wherein the tubular body further comprises a clay coating on the interior of the tubular body for fire resistance.

12. The apparatus of claim 1, wherein the tubular body comprises thick paper for sufficient fire resistance.

13. The apparatus of claim 1, wherein the tubular body further comprises an internally extending base shelf disposed at the base end of the body.

14. The apparatus of claim 1, further comprising an internally extending base shelf disposed at the base end of the body, and wherein the support is configured and positioned such that at least one edge of the support engages the shelf.

15. The apparatus of claim 1, further comprising an internally extending base shelf disposed at the base end of the body, wherein the support is configured and positioned such that at least one edge of the support engages the shelf, and wherein the base shelf extends only partially across the base end leaving an opening at the base end constituting at least part of the ventilation structure.

16. The apparatus of claim 1 further comprising apertures formed in the side wall of the body, the apertures constituting at least part of the ventilation structure.

* * * * *